United States Patent [19]

Grzeika

[11] 4,369,909

[45] Jan. 25, 1983

[54] GLAZIER'S POINT DRIVER

[76] Inventor: Eugene W. Grzeika, 170 Park St., Bristol, Conn. 06010

[21] Appl. No.: 48,000

[22] Filed: Jun. 13, 1979

Related U.S. Application Data

[62] Division of Ser. No. 924,447, Jul. 13, 1978, Pat. No. 4,342,414.

[51] Int. Cl.[3] ..... B25C 5/00

[52] U.S. Cl. ..... 227/109; 227/120; 227/132

[58] Field of Search ..... 227/109, 119, 120, 132, 227/146

[56] References Cited

U.S. PATENT DOCUMENTS

| | | | |
|---|---|---|---|
| 104,915 | 6/1870 | Woodworth et al. | 227/146 |
| 1,134,334 | 4/1915 | Hartley | 227/120 X |
| 1,744,700 | 3/1930 | Hubbard et al. | 227/132 |

FOREIGN PATENT DOCUMENTS

| | | | |
|---|---|---|---|
| 590966 | 1/1934 | Fed. Rep. of Germany | 227/109 |
| 2534878 | 2/1976 | Fed. Rep. of Germany | 227/132 |
| 1376987 | 9/1964 | France | 227/132 |

*Primary Examiner*—Paul A. Bell

[57] ABSTRACT

The glazier holds the toe of the driver on the glass, adjacent the edge of the sash, such that a handle trigger can be operated to drive the lowermost point from the magazine into the sash by the action of a coiled compression spring. The magazine has an insert associated with it so that points of various size can be accommodated in a single point driver. Since larger points require a greater spring force, means is also provided for conveniently adjusting the compression springs displacement. The guide block and push plate assembly for driving the points into the sash are slidably supported in the frame so as to precisely engage only the lowermost point in the stack.

12 Claims, 9 Drawing Figures

GLAZIER'S POINT DRIVER

RELATED APPLICATION

This application is a division of copending application Ser. No. 924,447 filed July 13, 1978 now U.S. Pat. No. 4,342,414 in the names of Eugene W. Grzeika and Vincent T, Kozyrski and entitled "Glazier's Point Driver."

Portable hand-operated point drivers for use by glaziers in assemblying glass in a window sash are generally trigger operated for forcibly driving the lowermost point in a stack of points provided in a magazine, and U.S. Pat. No. 1,744,700 shows the typical construction of present day point drivers. The magazine comprises an elongated receptacle for the stack of points, and a spring biased follower or bail urges the stack of points downwardly. The spring force exerted by the follower can be overcome to permit removal of the follower for reloading the magazine, but the magazine is generally so constructed as to receive only one particular size point.

A trigger mechanism is provided for operating a push plate, and includes a coiled compression spring, and a trigger return spring, and the trigger or handle comprises a bell crank which retracts, or cocks the push plate, such that when the compression spring reaches a predetermined position a predetermined spring force urges the lowermost point in the stack into the wood sash. Since points of only one predetermined size can be loaded in a particular point driver, the displacement and consequently the spring force provided by the compression spring, need readjustment only very infrequently. Once set up for driving a particular size point there is little need to alter this adjustment in prior art point drivers.

This invention relates generally to improvements over the above-described prior art point driver, and deals more particularly with improvements in the area of the magazine for such a point driver. The magazine to be described is so constructed and arranged as to accommodate stack of points of various size, and convenient means is provided for achieving precise adjustment for the spring force exerted on the particular point to be driven, in order to provide slightly larger impact forces for the larger sized points accommodated in the improved magazine.

In its presently preferred form, the point driver of the present invention comprises a frame of generally inverted U-shape, having a toe and a heel such that the toe portion can be placed against the wood sash, and the frame used by the glazier to hold the glass in place while a point is driven into the wood sash. A guide block assembly is slidably mounted in the frame and includes a driving plate which engages the lowermost point in the magazine to drive it from the stack. A trigger mechanism is provided for cocking the block, and for releasing it so that a compression spring moves the block along a fixed path in the frame to drive the point. The trigger mechanism includes an operating lever, a return spring and pivot means defining an axis for movement of the operating level. A lost motion means is provided between the operating lever and the guide block such that return movement of the operating lever can be achieved independently of the driving movement of the guide block. The magazine is adapted to accommodate the largest size point to be driven, and an insert is provided for the magazine, which insert defines a first guide surface for engaging a stack of slightly smaller points and a second guide surface for engaging a stack of points of still a third size and shape. Bail or follower means is provided to urge the stack of points downwardly so that the lowermost point occupies a position to be driven by a plate associated with the guide block. The follower is spring operated and so arranged as to be manually moved against the force of the spring from its active to an inactive position to permit reloading of the magazine.

Among the objects and advantages of the above-described invention the following deserves mention. First, to provide a point driver with an improved magazine such that points of various size can be accommodated in a single point driver structure, and with provision being made for utilization of the conventional spring loaded bail or follower arrangement for holding the stack of points in such magazine. Second, to provide a glazier's point driver wherein critical adjustments can be made to the impact force exerted by the coiled compression spring acting upon the guide block and point pusher plate, such adjustments being provided for in a convenient and repeatable manner so that the above-described advantage in terms of the accommodation of points of various size, can be achieved in a point driver wherein the impact force exerted on the point can be adjusted so as to be optimized for points of various size and weight.

Figure 1:
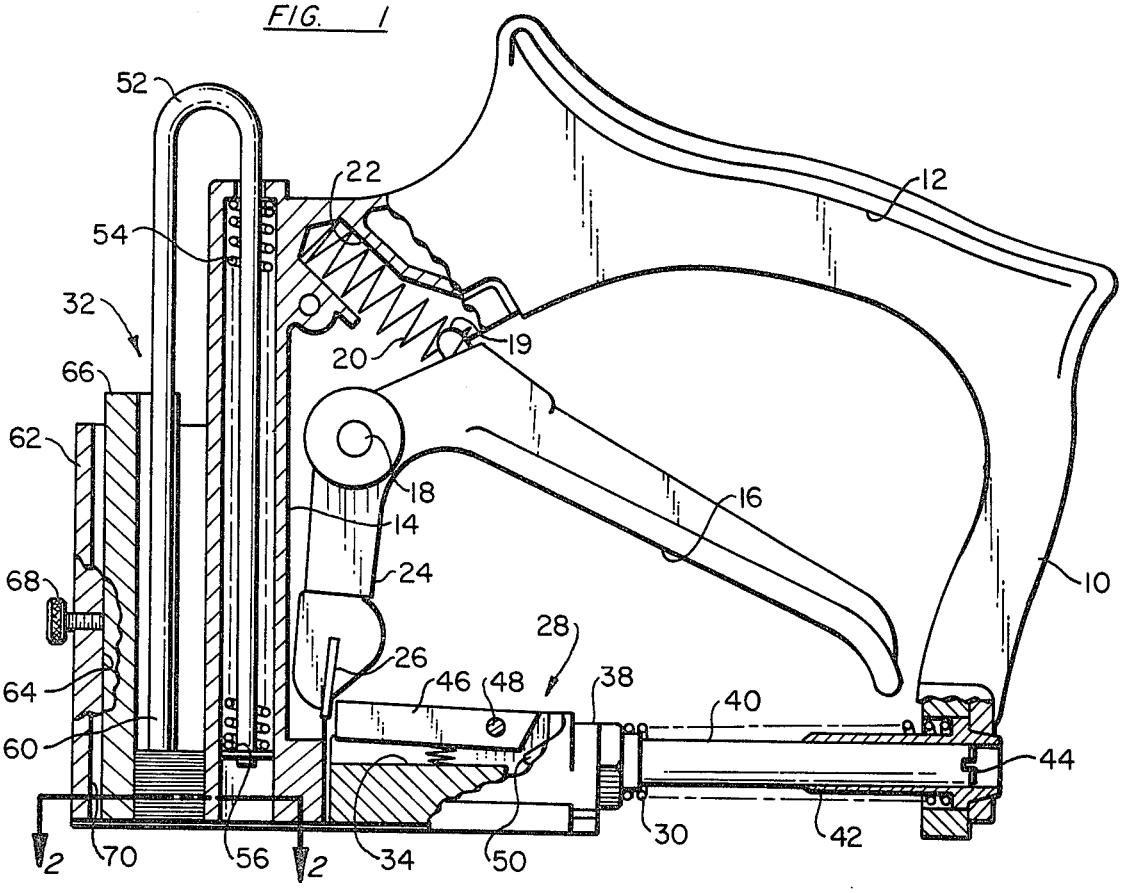
FIG. 1 is a vertical elevational view, partly in section, of a first embodiment of this invention.

Turning now to FIGS. 1 through 4 in greater detail, the point driver includes a frame 10 which has a generally inverted U-shape defining a rear leg, as shown at 10, a handle portion 12, and a front leg portion indicated generally at 14. The lower end of the front leg comprises a nose of the driver adapted to be placed against the window sash (not shown) while the user holds the device against the glass (not shown) preparatory to driving a point into the wooden sash.

An operating lever 16 is pivotally mounted in the fixed frame by pin 18, and the lever 16 is urged downwardly into the position shown by a return spring 20 acting between a land 19 spaced from the pivot 18 and a cavity 22 defined for the purpose in the frame. Still with reference to the operating lever 16, a depending crank portion 24 is provided with a blade 26 at its lower end such that squeezing the elements 12 and 16 pull upwardly on the operating lever 16, causing depending crank arm 24 to pivot counterclockwise with respect to the axis 18 retracting slide block mechanism 28 against the force of compression spring 30. This cocking motion stores energy in the spring 30 such that release of the spring 30 drives the lowermost point in a stack of points provided for this purpose in the magazine 32 at the forward end or leg of the frame.

Figure 2:
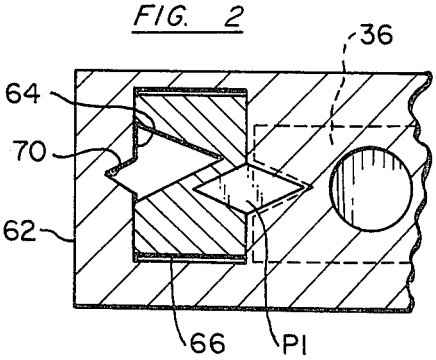
FIG. 2 is a sectional view taken generally on the line 2—2 of FIG. 1, and illustrating a magazine insert in one of two possible positions.
Figure 3:
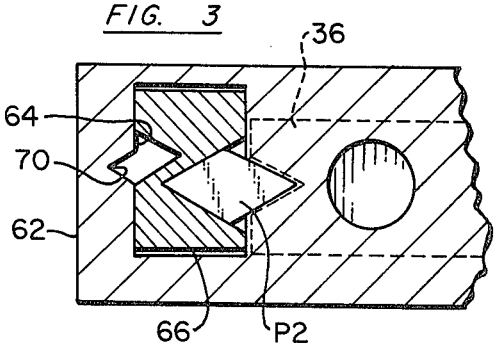
FIG. 3 is a sectional view similar to FIG. 2 but illustrating the magazine insert in an alternative position, that is in a position reversed from that of FIG. 2, so as to accommodate glazier's points of slightly larger size.
Figure 4:
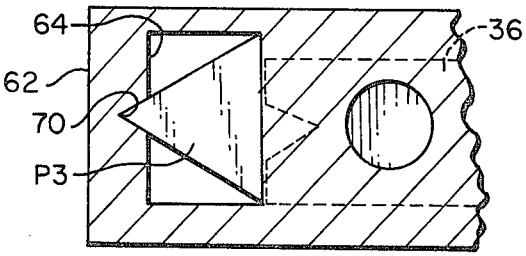
FIG. 4 is a sectional view generally similar to FIGS. 2 and 3 but illustrating the insert removed from the magazine such that the space occupied by the insert is adapted to receive a stack of points of still larger size.

The slide block mechanism 28 is generally similar to that shown in prior art U.S. Pat. No. 1,744,700 and comprises a block or plunger 34 slidable longitudinally in the lower end of the frame. A driving plate 36 is attached to the lower surface of this block 34 as best shown in FIGS. 2–4 and serves to drive the lowermost point in the stack toward the left in FIG. 1 (forwardly).

The slide or guide block assembly 28 further includes a catch lever 46 pivotally connected at 48 to the block 34 and spring biased to the position shown in FIG. 1 such that the blade 26 of operating lever 16 can urge the slide block rearwardly during cocking movement. However, as the operating lever 16 is squeezed upwardly for cocking motion, and after the desired displacement of coiled compression spring, blade 26 will move away from the lever 46 allowing the slide block assembly 26 to move forwardly. The operating lever 16 will still be in the squeezed position (not shown) but when subsequently released lever 46 is moved counterclockwise about its pivot 48 by return movement of blade 26 to allow return movement of the operating lever 16 and its associated depending crank 24 to the position shown in FIG. 1.

Rod 40 is threadably adjusted to the desired position in the rear end of the slide block assembly 28 by means of a slot 44, and this guide rod also provides a convenient support for the compression spring 30. The rod 40 is slidably received in a bushing 42 at the lower end of the rear leg 10 of the frame and the forward end of the rod 40 is secured to the rear end of the guide block by means of the threaded connection shown at 38.

The above described structure for the point driver of FIG. 1 is of conventional configuration, and it should perhaps be noted that the U-shaped follower 52 housed in the front leg 14 of the driver frame is also of conventional configuration. A spring 54 is provided on one leg of the follower and acts between the lower end of the follower leg, indicated generally at 56, and the upper end of a receptacle provided for this purpose in the frame as shown. The U-shaped follower 52 can be grasped by the operator so as to be pulled upwardly from the position shown, to a position where the lower end of follower leg 60 is raised clear of the upper end of the magazine 32 so that the follower 52 can be swung to one side in order to permit loading of the magazine 32 to be described. As so constructed and arranged a convenient means is provided for holding the stack of loose points in the magazine, and for permitting easy reloading of the magazine according to conventional practice.

Turning next to a more complete description of the magazine structure, indicated generally at 32 in FIG. 1, the forward portion of the front leg 14 of the frame, indicated generally at 62 is of generally rectangular plan form configuration as viewed in FIGS. 2–4 and defines a generally rectangular vertically extending opening as best shown at 64 in FIGS. 2–4. A generally rectangular insert 66 is adapted to be received in this rectangular magazine opening, and it is a feature of the present invention that this insert 66 is adapted to be received in the magazine opening in more than one possible orientation. A thumbscrew 68 is adapted to lock the insert in position either to receive relative small points as indicated generally at P1 in FIG. 2 for example or to be reoriented to receive points of different size. The insert 66 can be removed and reversed so as to be champed in the position shown for it in FIG. 3 in order to receive somewhat larger points as indicated generally at P2 in FIG. 3. Finally, and as shown in FIG. 4 even larger triangular points P3 can be accommodated by removal of the insert 66 and utilization of the generally triangular notch 70 provided for this purpose in the front wall 62 of the rectangular magazine recess 64.

Figure 5:
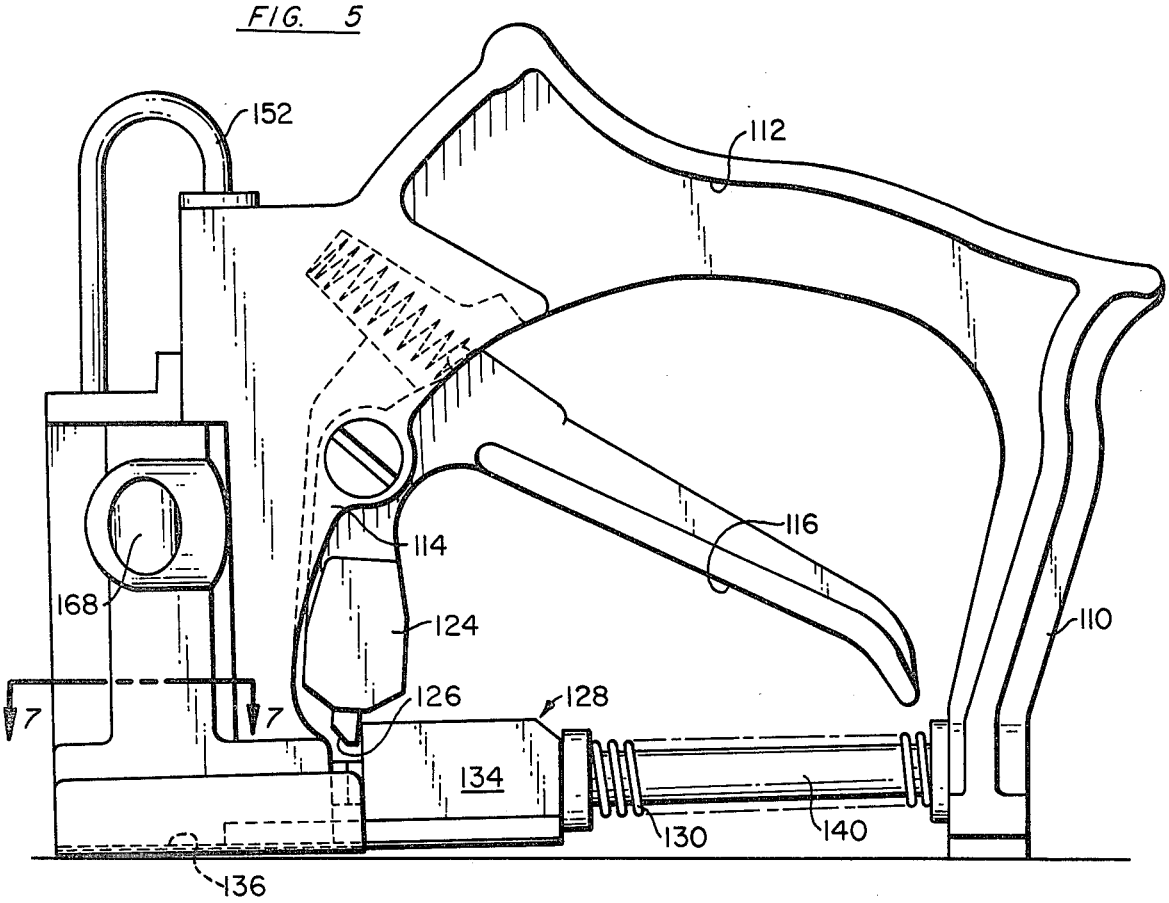
FIG. 5 is a side elevational view of a glazier's point driver constructed in accordance with a second, and presently preferred embodiment of this invention.
Figure 6:
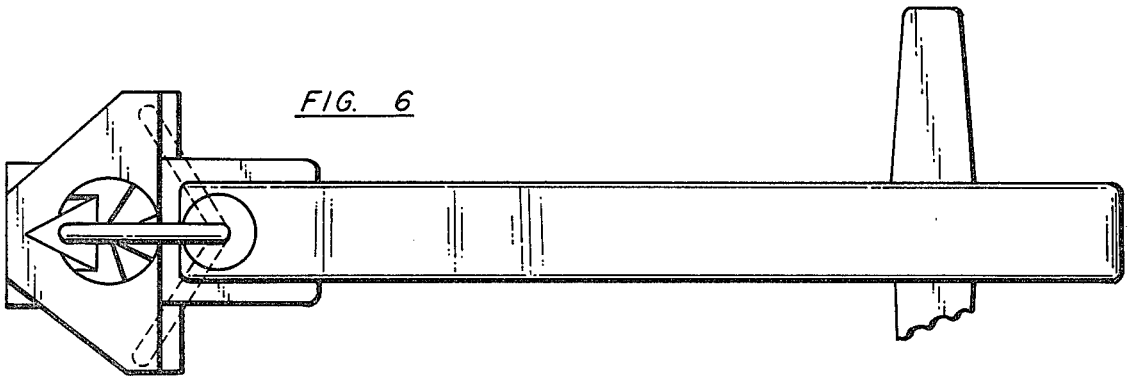
FIG. 6 is a top plan view of the point driver illustrated in FIG. 5.

Turning now to a description of the presently preferred embodiment for the point driver as illustrated in FIGS. 5 through 9 inclusively, the inverted U-shaped frame shown in FIG. 5 is generally similar to that in FIG. 1 having a rear leg 110, a handle portion 112 and a forward leg 114 which defines a magazine for the stack of points to be driven. The operating lever 116 comprises a bell crank with a lower depending arm 124 with the end portion 126 for engaging the slide block assembly 128. The forward end of the member 126 is beveled or canted slightly as shown in FIG. 5 so that like blade 26 in FIG. 1, upon achieving cocking movement of the slide block assembly 128 the pusher or drive plate 136 will move forwardly upon achieving the desired displacement of the coiled compression spring 130 as with the above-described device with reference to FIG. 1. Upon release by the user of the operating handle 116 member 126 will engage the upper surface of the block 134 during its return movement allowing it to reassume the position shown for it in FIG. 5 preparatory to driving another point from the lower end of the magazine.

Figure 7:
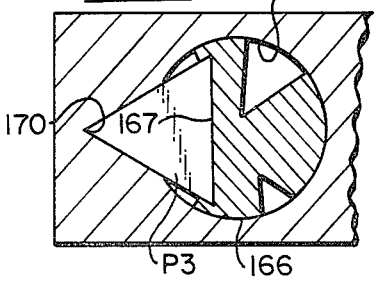
FIG. 7 is a horizontal sectional view taken generally on the line 7—7 of FIG. 5, and illustrating the insert of FIG. 6 in one of three alternative positions.
Figure 8:
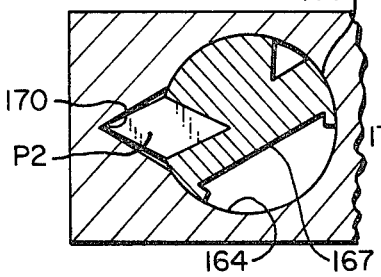
FIG. 8 is a sectional view generally similar to FIG. 7 but illustrating the insert rotated to a position approximately 120° from the FIG. 7 position such that a point of slightly smaller size can be accommodated.
Figure 9:
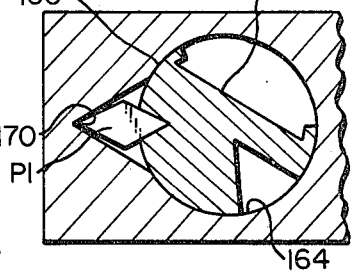
FIG. 9 is a sectional view generally similar to FIGS. 7 and 8 but illustrating the insert rotated to a still different position so as to accommodate glazier's points of smaller size than those shown in FIGS. 7 and 8.

Turning now to a more complete description of the frame for the FIG. 5 driver, a generally cylindrical magazine is provided in the forward leg 114 of the frame to receive a unique insert, best shown in FIGS. 7, 8 and 9 at 166. A cylindrical upwardly open bore 166 is provided in the lower leg 114 of the frame of the point driver and the insert 166 is shown in one position in FIG. 7, that is in position for driving generally triangular points P3 of the largest size normally used. FIG. 8 shows the insert 166 rotated approximately 120° counterclockwise in order to accommodate diamond shaped points P2 of intermediate size, and FIG. 9 shows the insert 166 rotated through a still further angle to present a relatively small guide surface to orient relatively small diamond shaped points P1. Unlike the insert 66 described above with reference to the FIG. 1 embodiment the insert 166 cooperates with a triangular notch 170 defined in the forward surface of the generally cylindrical magazine bore 164, and all three style points are adapted to be received between said triangular notch and one of three guide surfaces defined at an angularly spaced location in the cylindrical surface of the insert 166. For example, in FIG. 7, the relatively large triangular insert P3 has one apex of its triangle received in the notch 170, and has the base of the triangle received in the cut away portion 167 of insert 166 as shown to best advantage in FIGS. 8 and 9. Similar cut away portions of the insert are provided for defining guide surfaces to accommodate the inserts P1 and P2 respectively, and means may be provided for releasably retaining the insert 166 in the magazine cavity 164 in any one of these three angular orientations as depicted in FIGS. 7, 8 and 9. A ball detent subassembly may be used as suggested in broken lines in FIG. 7, for this purpose with the spring loaded ball detent barrel being provided threadably in a cavity defined for this purpose in the insert, and with three detents being defined in the cylindrical side wall of the cavity 164 in order to receive the ball, and thereby releasably retain the insert in the desired angular position.

The points are thus retained in the magazine between the insert and the side wall defined by the forward leg of the frame. These points are urged downwardly by a follower 152 much like that described above with reference to the FIG. 1 embodiment. A spring is provided to urge the follower downwardly so that one leg engages the top of the stack of inserts in the magazine and the other leg is engaged by a spring acting between the frame and its lower end for this purpose. Spring force can be manually overcome by the user as a result of grasping the U-shaped upper bail portion, of the follower 152 and pulling it upwardly. Rotating the follower to one side as suggested in FIG. 6 by the broken lines in that view serves to store the follower in an inactive position in order to reload the magazine with points of the same size or to allow rotation of the insert so as to receive points of a different size. The forward leg 114 of the frame may include clearance openings 168 on either side of the magazine defining structure so as to permit the user to use his fingers to move the cylindrical insert upwardly out of its associated cavity if this be necessary for any reason.

I claim:

1. In a glazier's point driver having a frame defining a magazine for the points, a point driving plate supported by the frame, trigger means for operating said point driving plate, and means biasing a stack of points in said magazine toward one end of the magazine wherein the endmost point is in position to be driven by the plate, the improvement to said magazine comprising elongated insert means for said magazine and defining a first guide surface for engaging a stack of points of one particular size and shape, said insert means defining a second guide surface for engaging a stack of points of a second and different size and shape, said insert means mounted in said frame to cooperate with said magazine when oriented in a first and a second position alternatively, said stack biasing means and said point driving plate adapted to operate as aforesaid with said insert means in both said alternative positions.

2. The combination defined in claim 1 wherein said elongated insert means defines a third guide surface for engaging a stack of points of a third size and shape, said insert means mounted in said frame to cooperate with said magazine when oriented in a third position angularly spaced from said first and second alternative positions.

3. The combination defined in claim 1 or 2 wherein said elongated insert is rotatable about its longitudinal axis in said magazine, at least when no points are stacked in either of said insert positions.

4. The combination defined in claim 1 including a point driving block slidably mounted in said frame and supporting said driving plate for engaging the endmost point in the magazine to drive it from the stack, drive means for driving said block, said trigger mechanism including an operating lever and spring return means for said lever, said trigger mechanism being operative for cocking the block against the bias of said drive means.

5. The combination defined in claim 1 wherein a wall of said magazine is provided with a notch for cooperating with one of said guide surfaces for alignably engaging a stack of points therebetween.

6. In a glazier's point driver having a frame defining a magazine for the points, trigger means for operating a point driving plate, and means biasing a stack of points towards one end of the magazine wherein the endmost point is in position to be driven by the plate, the improvement to said magazine comprising elongated insert means for said magazine and defining a first guide surface for engaging a stack of points of one particular size and shape, said insert means defining a second guide surface for engaging a stack of points of a second and different size and shape, said insert means mounted in said frame to cooperate with said magazine when oriented in a first and a second position alternatively, said stack biasing means and said point driving plate adapted to operate as aforesaid with said insert means in both said alternative positions.

7. The combination defined in claim 1 wherein said elongated insert means defines a third guide surface for engaging a stack of points of a third size and shape, said insert means mounted in said frame to cooperate with said magazine when oriented in a third position angularly spaced from said first and second alternative positions.

8. The combination defined in claim 1 or 2 wherein said elongated insert is rotatable about its longitudinal axis in said magazine, at least when no points are stacked in either of said insert positions.

9. In a glazier's point driver having a frame with an opening forming a magazine for a stack of points, point driving means for driving the points at one end of the magazine, and means biasing the points along an axis of the stack towards one end of the magazine wherein the endmost point is in position to be driven by the point driving means, the improvement comprising a point stack guiding insert mounted in said magazine opening and adapted to be oriented about an axis parallel to said stack axis in at least first and second alternative angular positions, said insert defining a first guide surface for guiding a first stack of points when the insert is in said first angular position, said insert defining a second guide surface angularly spaced from said first guide surface for guiding a second stack of points of different dimensions when the insert is in said second angular position, said magazine having point guiding means cooperating with said insert when oriented in both said first and second angular positions to guide said first and second stack of points respectively, said stack biasing means and said point driving means being adapted to operate as aforesaid with said insert in both said alternative positions.

10. The point driver of claim 9 wherein the point stack guiding insert is an elongated member and is oriented about its longitudinal axis in said first and second angular positions.

11. The point driver of claim 9 wherein the point stack guiding insert is of generally rectangular transverse cross section and said first and second guide surfaces extend axially along side walls thereof and alternatively are in confronting relationship with said magazine's point guiding means when said insert is oriented in said first and second angular positions respectively.

12. In a glazier's point driver having a frame defining a magazine for the points, trigger means for operating a point driving plate, and means biasing a stack of points toward one end of the magazine wherein the endmost point is in position to be driven by the plate, the improvement to said magazine comprising triangular notch defining means in the frame and in communication with a magazine opening also defined by the frame, elongated insert means for said magazine opening and defining a first guide surface for engaging a stack of points of one particular size and shape, said insert means defining a second guide surface for engaging a stack of points of a second and different size and shape, at least one of said guide surfaces defined by said insert means having a shape suitable for receiving a stack of triangular points with their apices in said triangular notch defining means in the frame and with the bases of such triangular points nested in said one guide surface defined by said insert means, said insert means mounted in said frame so that said guide surfaces cooperate with said magazine notch means when oriented in a first and a second position alternatively, said stack biasing means and said point driving plate adapted to operate as afore said with said insert means in both said alternative positions.

* * * * *